US010450910B2

(12) United States Patent
Morihiro

(10) Patent No.: US 10,450,910 B2
(45) Date of Patent: Oct. 22, 2019

(54) INTERNAL COMBUSTION ENGINE

(71) Applicant: TOYOTA JIDOSHA KABUSHIKI KAISHA, Toyota (JP)

(72) Inventor: Shunji Morihiro, Seto (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 31 days.

(21) Appl. No.: 15/966,531

(22) Filed: Apr. 30, 2018

(65) Prior Publication Data

US 2018/0328242 A1 Nov. 15, 2018

(30) Foreign Application Priority Data

May 12, 2017 (JP) ..... 2017-095540

(51) Int. Cl.
*F01M 11/03* (2006.01)
*F01M 1/02* (2006.01)
*F01M 11/00* (2006.01)

(52) U.S. Cl.
CPC ..... *F01M 11/03* (2013.01); *F01M 1/02* (2013.01); *F01M 11/0004* (2013.01); *F01M 2011/0029* (2013.01)

(58) Field of Classification Search
CPC ..... F01M 11/03; F01M 1/02; F01M 11/0004; F01M 2011/0029; F01M 13/00
USPC ..... 123/196 A, 196 CP
See application file for complete search history.

(56) References Cited

U.S. PATENT DOCUMENTS 6,101,996 A * 8/2000 Arita ..... B01D 29/21 123/196 A
7,047,930 B2 * 5/2006 Sitzberger ..... F01M 11/0408 123/196 R
8,161,953 B1 * 4/2012 Mordukhovich ..... C10M 175/0008 123/196 A
2010/0230212 A1 * 9/2010 Jensen ..... B01D 35/027 184/6.24

FOREIGN PATENT DOCUMENTS

JP 10-252437 9/1998
JP 2008-184924 8/2008
JP 2013-96238 5/2013

* cited by examiner

*Primary Examiner* — Syed O Hasan
(74) *Attorney, Agent, or Firm* — Oblon, McClelland, Maier & Neustadt, L.L.P.

(57) ABSTRACT

An internal combustion engine includes: a case; an oil pan disposed below the case; an oil filter into which oil inside the oil pan flows; and a guide that guides oil flowing out from the oil filter and flowing down along a sidewall surface of the case. The guide includes a projection that is provided continuously in a transverse direction in the sidewall surface of the case and extends so as to project outside the case from the sidewall surface, a descending portion that is extended downward from an outer peripheral edge of the projection, and a collecting portion that is positioned in a lower end edge of the descending portion and collects the oil that flows along the sidewall surface of the case downwardly from the projection through the descending portion.

7 Claims, 7 Drawing Sheets

INTERNAL COMBUSTION ENGINE

INCORPORATION BY REFERENCE

The disclosure of Japanese Patent Application No. 2017-095540 filed on May 12, 2017 including the specification, drawings and abstract is incorporated herein by reference in its entirety.

BACKGROUND

1. Technical Field

The disclosure relates to an internal combustion engine including an oil pan and an oil filter.

2. Description of Related Art

An internal combustion engine includes a lubrication mechanism that allows lubricating oil to move from top to bottom of the internal combustion engine so that the lubricating oil reaches the entire internal combustion engine in order to ensure smooth operations of a valve mechanism, a piston, a crankshaft, and so on. The lubricating oil that has lubricated the crankshaft and so on is recovered and stored in an oil pan that is prepared at the bottom. The lubrication mechanism includes a circulation route. In the circulation route, an oil filter is installed, and the lubricating oil inside the oil pan is returned to the top (see Japanese Unexamined Patent Application Publication No. 2008-184924 (JP 2008-184924 A).

As shown in FIG. 6, in such an internal combustion engine, a filter-attaching portion 15 where an oil filter 13 is attached and detached is disposed in a sidewall surface 11*a* of a case 11. As shown in FIG. 7, in the filter-attaching portion 15, depending on circulation pressure of lubricating oil and an attachment state of the oil filter 13, the lubricating oil leaks out from the filter-attaching portion 15, and flows down along the sidewall surface 11*a* of the case 11. In the filter-attaching portion 15, when the oil filter 13 is detached for replacement and so on, remaining lubricating oil flows down along the sidewall surface 11*a* of the case 11. Then, the oil flowing down goes around and reaches a lower surface side of the oil pan, and then spreads over an entire surface. Thus, a workload of wiping the oil becomes necessary.

SUMMARY

Therefore, the disclosure relates to an internal combustion engine that restricts oil from going around and reaching a lower surface side of an oil pan.

An exemplary aspect of the disclosure is an internal combustion engine. The internal combustion engine comprising: a case; an oil pan disposed below the case; an oil filter into which oil inside the oil pan flows; and a guide that guides oil flowing out from the oil filter and flowing down along a sidewall surface of the case. The guide includes a projection that is provided continuously in a transverse direction in the sidewall surface of the case and extends so as to project outside the case from the sidewall surface, a descending portion that is extended downward from an outer peripheral edge of the projection, and a collecting portion that is positioned in a lower end edge of the descending portion and collects the oil that flows along the sidewall surface of the case downwardly from the projection through the descending portion.

The internal combustion engine may further include an attaching-detaching portion where the oil filter is attached and detached. The attaching-detaching portion may be disposed in the sidewall surface of the case. The guide may be positioned in a fluid passage of oil that flows from the attaching-detaching portion to below the oil pan. As described above, according to the aspect of the disclosure, for example, the lubricating oil leaking out from the attaching-detaching portion and flowing down along the sidewall surface of the case is directed and guided by the guide so that the oil is collected and flows down.

The case may be a crankcase and the projection may be disposed in a flange that connects the crankcase and the oil pan each other.

The lubricating oil guided by the guide flows along the projection that is, for example, a flange that is positioned in a boundary between a case body and the oil pan. The projection is provided continuously in a transverse direction in the sidewall surface of the case and extends so as to project outwardly to the side from the sidewall surface. Then, the lubricating oil further flows along the descending portion that is extended downward from an outer peripheral edge of the projection. The lubricating oil flowing down along the descending portion of the guide is guided by the collecting portion that is formed in the lower end edge of the descending portion. Then, the oil is collected in one place and dripped.

The collecting portion may be formed into a shape in which a convex-shaped apex of the collecting portion in the lower end edge of the descending portion is at a lowermost position compared to adjacent lines on both sides of the apex.

The collecting portion may be disposed into a convex shape in which an apex of the convex shape is at a lowermost position between a concave shape and at least one of adjacent lines of the concave shape. The concave shape may be made in the lower end edge of the descending portion.

The lower end edge may have a convex shape that extends downward. The lower end edge may include a convex-shaped apex and adjacent lines positioned on both ends of the apex, respectively. The apex may be the collecting portion and positioned lower than the adjacent lines.

The lower end edge may have a concave shape that is depressed upward, the lower end edge may include the adjacent lines. The descending portion may have a convex portion that is disposed between the concave shape and at least one of the adjacent lines of the concave shape. The convex portion may include an apex that is positioned lower than the lower end edge. The apex may be the collecting portion.

Therefore, the lubricating oil flowing along the sidewall surface of the case can be restricted from going around and reaching a lower surface of the oil pan, thus making the oil drip down. Thus, it is possible to easily reduce a workload of wiping and so on for the lubricating oil.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, an embodiment of the disclosure is described in detail with reference to the drawings. FIG. 1 to FIG. 4 are views of an internal combustion engine according to the embodiment of the disclosure.

Figure 1:
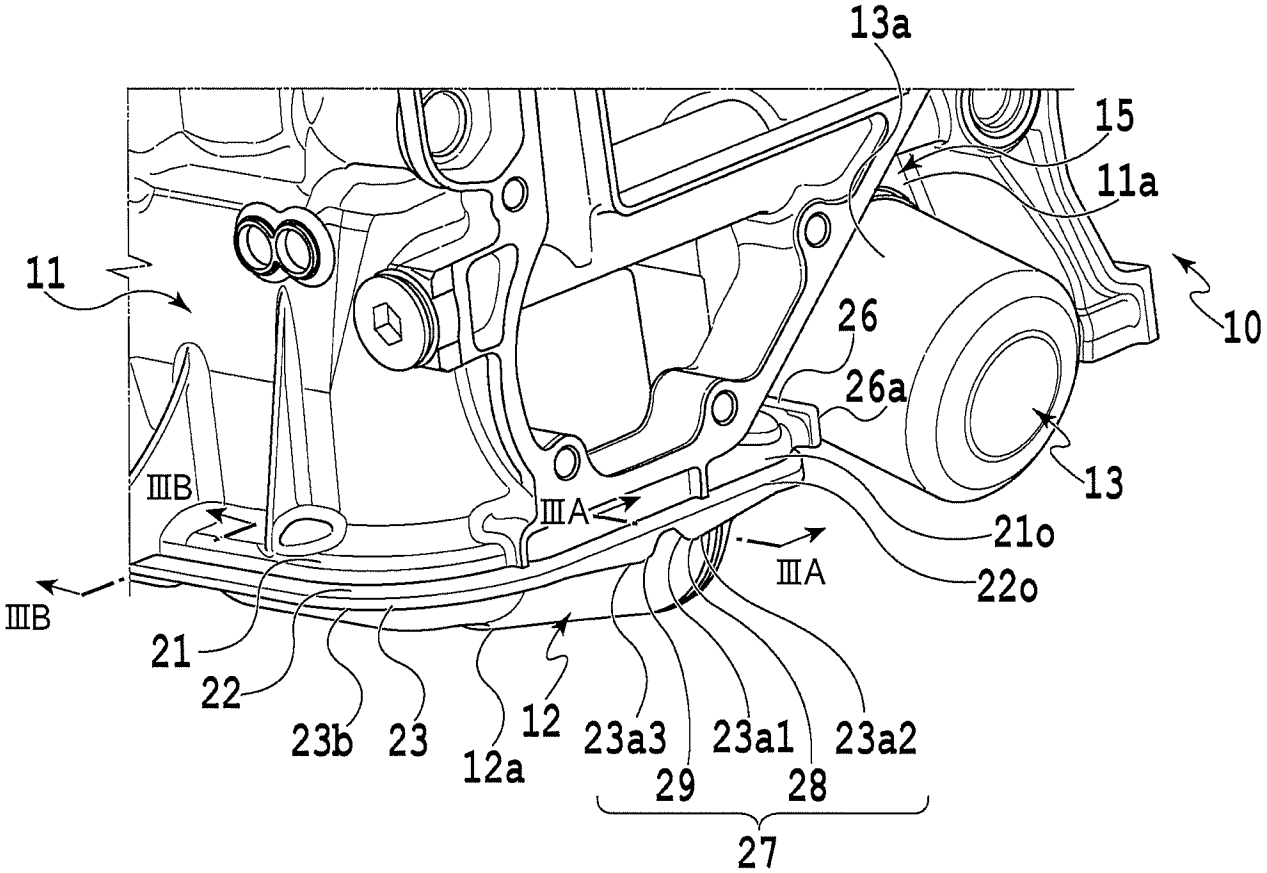
FIG. 1 a view of an internal combustion engine according to an embodiment of the disclosure, and is an enlarged perspective view of a part of a schematic structure of the internal combustion engine.

In FIG. 1, in an internal combustion engine 10, an oil pan 12 is attached on a lower surface of a crankcase 11. In the internal combustion engine 10, housing space in the crankcase 11 is closed by the oil pan 12. The housing space in the crankcase 11 houses a crankshaft that generates rotary power from upward-downward motions of a piston inside a cylinder block. In the internal combustion engine 10, lubrication of each component is ensured by lubricating oil that flows down and spreads from a valve mechanism towards the piston, the crankshaft, and so on. The valve mechanism is housed inside a cylinder head in an upper portion of the internal combustion engine 10. The lubricating oil is recovered and stored inside the oil pan 12. Thus, in the internal combustion engine 10, the crankcase 11 forms a part of a case that houses the components, and the oil pan 12 is installed as a part of the crankcase 11.

In the internal combustion engine 10, an oil filter 13 is attached on a side surface of the crankcase 11 in a detachable manner. The internal combustion engine 10 includes an outgoing oil passage and a returning oil passage, as well as an oil pump. In the outgoing oil passage, the lubricating oil is allowed to go down from the upper portion into the oil pan 12 in a lower portion. In the returning oil passage, the lubricating oil is returned to the upper portion from the oil pan 12. The oil pump allows the lubricating oil to flow inside the returning oil passage and circulate. The oil filter 13 is installed in the returning oil passage in a middle of a route of the circulation.

In the crankcase 11, a filter-attaching portion (an attaching-detaching portion) 15 is formed in a sidewall surface (a side surface) 11*a* that is an outer peripheral surface. The oil filter 13 is attached to and detached from the filter-attaching portion 15 so that the oil filter 13 can be replaced. The oil filter 13 is attached to the filter-attaching portion 15 by gripping and then, for example, rotating a generally cylindrical grip portion 13*a* so that the oil filter 13 is pushed in. The oil filter 13 is attached in a state where an end surface of the grip portion 13*a* abuts on the filter-attaching portion 15.

Therefore, in the crankcase 11, depending on circulation pressure of the lubricating oil during an operation, the lubricating oil leaks out from an outer peripheral side of the filter-attaching portion 15 in the sidewall surface 11*a* where the oil filter 13 is attached, and then flows down along the sidewall surface 11*a* towards the oil pan 12 side in the lower portion.

In portions of the crankcase 11 and the oil pan 12 that are connected with each other, flange-shaped portions 21, 22 are formed, respectively. In the flange-shaped portions 21, 22, abutting surfaces 21*j*, 22*j* are formed, respectively, and closely connected with each other so as to abut on each other. The abutting surfaces 21*j*, 22*j* have projecting shapes that extend outwardly to the side so that the abutting surfaces 21*j*, 22*j* have certain amounts of areas. Thus, the flange-shaped portions 21, 22 are formed as projections.

Here, in the internal combustion engine 10, a cylinder inside the cylinder block located in an upper portion of the crankcase 11 is formed into a shape that is slightly inclined with respect to the vertical direction, and the cylinder block is assembled so that the piston has upward-downward motions inside the cylinder. Therefore, the crankcase 11 is also assembled to a vehicle in a position that makes the sidewall surface 11*a* inclined. The oil pan 12 is fabricated so that a lower surface 12*a* of the oil pan 12 is generally horizontal in a state where the oil pan 12 is attached to a lower portion of the crankcase 11. Therefore, the flange-shaped portions 21, 22 of the crankcase 11 and the oil pan 12 have the inclined abutting surfaces 21*j*, 22*j*, respectively, and, in the embodiment, the crankcase 11 and the oil pan 12 are attached so that an upper surface 21*a* of the flange-shaped portion 21 of the crankcase 11 makes a slope that goes downward as a distance from the filter-attaching portion 15 becomes longer.

A first oil thrower portion 26 is integrally formed in the upper surface 21*a* of the flange-shaped portion 21 of the crankcase 11 at a position adjacent (close) to the filter-attaching portion 15. The first oil thrower portion 26 is formed into a rib-shape that projects upwardly from the upper surface 21*a* of the flange-shaped portion 21. The first oil thrower portion 26 is disposed in a position in the flange-shaped portion 21, the position being slightly lower than a position proximate and closest to the filter-attaching portion 15. In the position of the first oil thrower portion 26, there is space (area) that directs and guides the lubricating oil flowing from the sidewall surface 11*a* side.

Figure 2A:
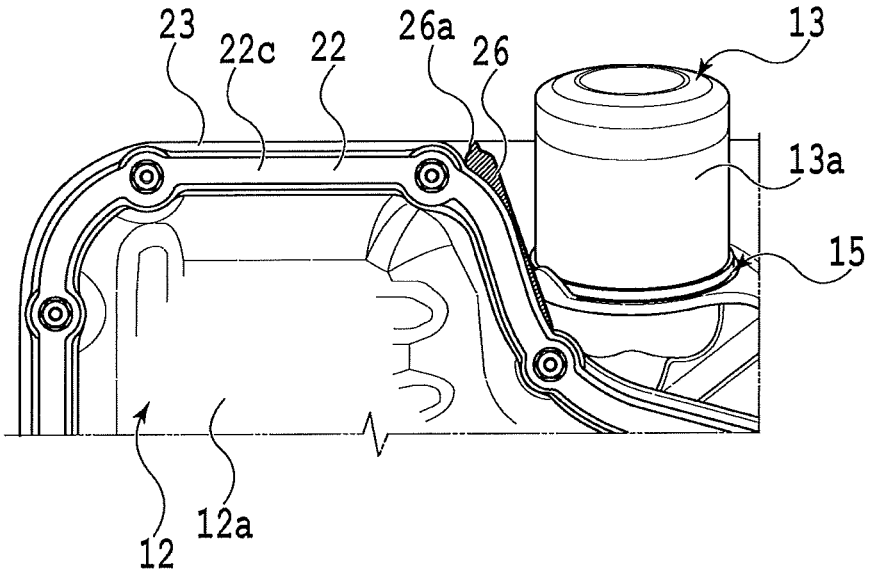
FIG. 2A is a bottom view of a structure of a main portion of the internal combustion engine seen from below.
Figure 2B:
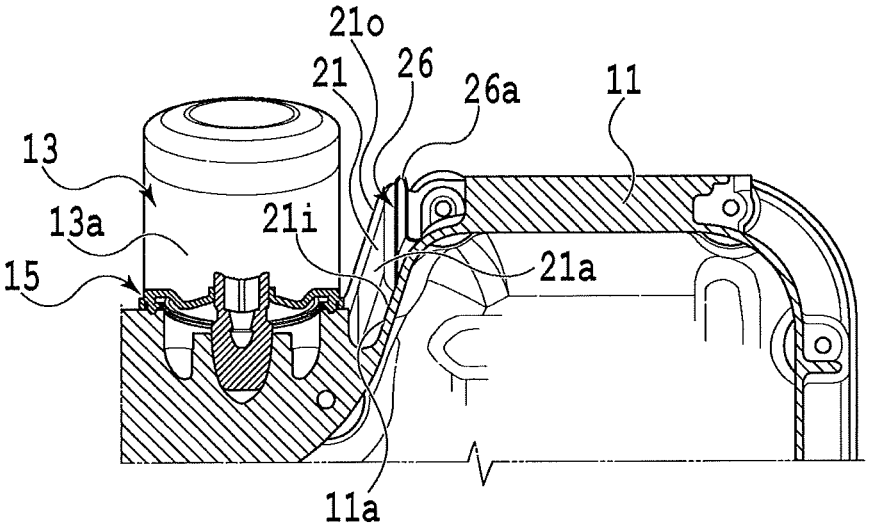
FIG. 2B is a partially cut top view of the structure of the main portion of the internal combustion engine seen from above.

As shown in FIG. 2A and FIG. 2B, the first oil thrower portion 26 is formed into the rib-shape that extends outwardly to the side from an inner peripheral edge 21*i* of the flange-shaped portion 21 on the side of the sidewall surface 11*a* of the crankcase 11 towards an outer peripheral edge 210 of the flange-shaped portion 21 so that a distal end portion 26*a* projects outside the outer peripheral edge 21*o*. Thus, the first oil thrower portion 26 is formed into a so-called overhang shape in which the distal end portion 26*a* is positioned outside the outer peripheral edge 210 of the flange-shaped portion 21.

Figure 4:
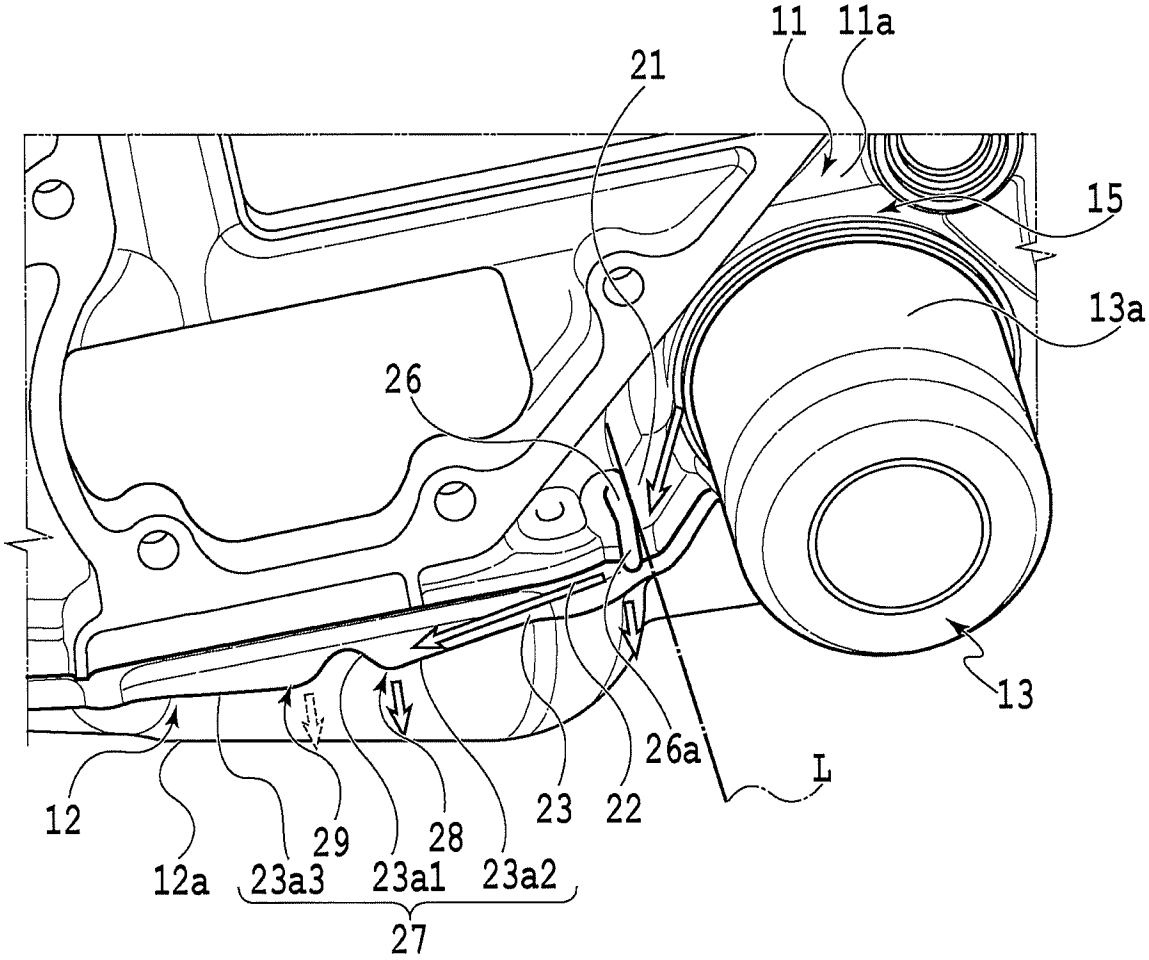
FIG. 4 is an enlarged perspective view of a part of the internal combustion engine, illustrating action effects of the internal combustion engine.

Thus, as shown in FIG. 4, the lubricating oil leaking out from the filter-attaching portion 15 of the crankcase 11 and flowing along the sidewall surface 11*a* is received once by the upper surface 21*a* of the flange-shaped portion 21 and then flows in a direction along the inner peripheral edge 21*i*. Then, the lubricating oil is dammed in the first oil thrower portion 26, guided to move towards the outer peripheral edge 21*o*, and dripped from the distal end portion 26*a*. This means that the first oil thrower portion 26 forms a guide-shaped portion that is positioned in a middle of a fluid passage L of the lubricating oil going down to the upper surface 21*a* of the flange-shaped portion 21 along the sidewall surface 11*a* of the crankcase 11. The guide-shaped portion collects the lubricating oil flowing down and guides the lubricating oil to a direction towards the outer peripheral edge 210 from the inner peripheral edge 21*i*. Further, because the first oil thrower portion 26 forms the overhanging guide-shaped portion, the lubricating oil is dripped from the distal end portion 26*a* that is positioned outside the outer peripheral edge 210 of the flange-shaped portion 21 of the sidewall surface 11*a* of the crankcase 11. Therefore, the lubricating oil does not go around and reach the lower surface 12*a* side of the oil pan 12, and it is thus possible to avoid a workload of wiping a large area of the lower surface 12*a*.

Figure 3A:
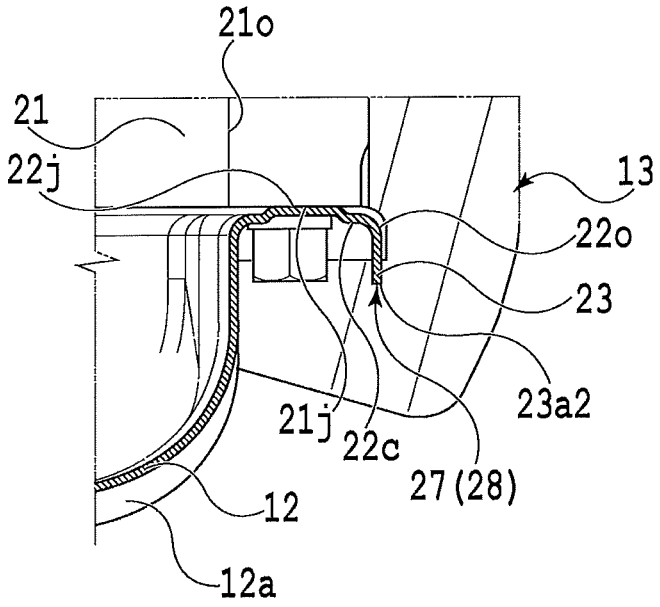
FIG. 3A is an enlarged longitudinal sectional view of a part of the main portion of the internal combustion engine taken along the line IIIA-IIIA in FIG. 1.
Figure 3B:
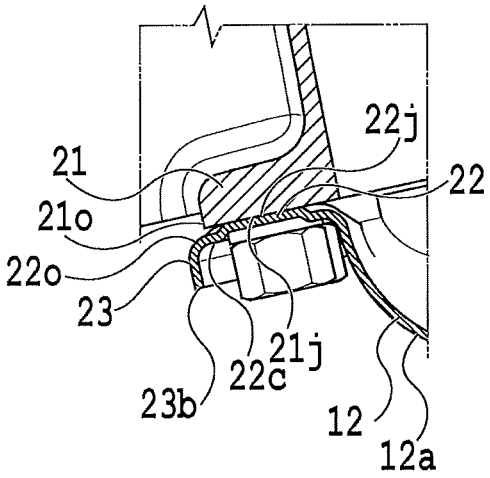
FIG. 3B is an enlarged longitudinal sectional view of a part of a portion other than the main portion of the internal combustion engine taken along the line IIIB-IIIB in FIG. 1.

Also, returning to FIG. 1, the flange-shaped portion 22 of the oil pan 12 is formed into a projecting shape that continues in a transverse direction along the sidewall surface 11*a* so as to superimpose the flange-shaped portion 21 of the crankcase 11, and also projects outwardly to the side from the sidewall surface 11*a*. In addition to this, as shown in FIG. 3A and FIG. 3B, in the flange-shaped portion 22 of the oil pan 12, a skirt-shaped portion 23 that is bent downwardly so as to be continuous from the projecting shape is formed continuously across the entire (the entire length of the) outer peripheral edge 210 of the flange-shaped portion 21 of the crankcase 11. This means that the skirt-shaped portion 23 forms a descending portion.

Thus, the entire lubricating oil leaking out from the filter-attaching portion 15 of the crankcase 11 and flowing along the sidewall surface 11*a* may not be dealt with by the first oil thrower portion 26, and flow along the skirt-shaped portion 23 on the oil pan 12 side. Even in this case, the lubricating oil does not go around and reach the lower surface 12*a* side of the oil pan 12 from a lower end edge 23*a* of the skirt-shaped portion 23. Therefore, it is possible to avoid a workload of wiping a large area of the lower surface 12*a* of the oil pan 12.

Further, as shown in FIG. 3A, a second oil thrower portion 27 is provided in the skirt-shaped portion 23 of the oil pan 12. In the second oil thrower portion 27, the lower end edge 23*a* is formed into a shape that is deformed in an upward-downward direction at a position that is farther from the filter-attaching portion 15 and lower than the first oil thrower portion 26. In a portion where the second oil thrower portion 27 is not formed, a base 23*b* of the lower end edge 23*a* of the skirt-shaped portion 23 is formed into, for example, a linearly continuous shape as shown in FIG. 3B.

The second oil thrower portion 27 is installed as the lower end edge 23*a* of the skirt-shaped portion 23 is deformed in the upward-downward direction and thus includes a concave curve shape. To be in detail, a concave curve edge 23*a*1 having a concave inner edge, and an adjacent line 23*a*2 are formed in the lower end edge 23*a* of the skirt-shaped portion 23. The adjacent line 23*a*2 is adjacent to the concave curve edge 23*a*1 on the filter-attaching portion 15 side. Thus, a convex edge 28 having a lowermost apex is provided between the adjacent line 23*a*2 and the concave curve edge 23*a*1, thereby making the second oil thrower portion 27.

Thus, as shown in FIG. 4, in the case where the entire lubricating oil leaking out from the filter-attaching portion 15 of the crankcase 11 and flowing along the sidewall surface 11*a* is not dealt with by the first oil thrower portion 26, and flows down along the lower end edge 23*a* of the skirt-shaped portion 23, the lubricating oil is collected by the apex of the convex edge 28 and dripped. The apex of the convex edge 28 is in a halfway position from the adjacent line 23*a*2 to the concave curve edge 23*a*1 in the second oil thrower portion 27. This means that, by making a collecting portion where the lubricating oil guided by the convex edge 28 of the second oil thrower portion 27 is collected in one place, it is possible to more reliably prevent the lubricating oil from going around and reaching the lower surface 12*a* of the oil pan 12. Therefore, it is possible to avoid a workload of wiping a large area of the lower surface 12*a* of the oil pan 12.

Further, as shown in FIG. 3A and FIG. 3B, in the second oil thrower portion 27, adjacent lines 23*a*2, 23*a*3 (see FIG. 3A) are adjacent to both sides of the concave curve edge 23*a*1, respectively, and the second oil thrower portion 27 is formed into a shape that makes the adjacent lines 23*a*2, 23*a*3 more separated from the outer peripheral edge 210 of the flange-shaped portion 21 in the downward direction as the adjacent lines 23*a*2, 23*a*3 become closer to the concave curve edge 23*a*1 compared to the base 23*b* (see FIG. 3B) of the lower end edge 23*a* of the skirt-shaped portion 23. This means that, in addition to the convex edge 28 between the adjacent line 23*a*2 and the concave curve edge 23*a*1, a convex edge 29 having a lowermost apex is also formed between the concave curve edge 23*a*1 and the adjacent line 23*a*3 as the second oil thrower portion 27 of the lower end edge 23*a* of the skirt-shaped portion 23. The adjacent line 23*a*3 is adjacent to the concave curve edge 23*a*1 on the opposing side of the concave curve edge 23*a*1 from the filter-attaching portion 15.

Because of this, in the second oil thrower portion 27, the convex edge 29 also forms the collecting portion on the side of the concave curve edge 23*a*1 away from the filter-attaching portion 15, and it is thus possible to collect and drip the flowing lubricating oil at the apex of the convex edge 29. Therefore, the lubricating oil is more reliably prevented from going around and reaching the lower surface 12*a* of the oil pan 12, thereby avoiding a workload of wiping and so on.

As described so far, in the internal combustion engine 10 according to the embodiment, the skirt-shaped portion 23 is formed in the flange-shaped portion 22 of the oil pan 12 so that the skirt-shaped portion 23 continues from the outer peripheral edge 210 of the flange-shaped portion 21 of the crankcase 11. Also, the concave curve edge 23*a*1 and the adjacent lines 23*a*2, 23*a*3 are formed in the lower end edge 23*a* of the skirt-shaped portion 23. Thus, the second oil thrower portion 27 having the convex edges 28, 29 is installed. Therefore, the lubricating oil that leaks out from the filter-attaching portion 15 and flows along the sidewall surface 11*a* is guided towards the apexes of the convex edges 28, 29 of the second oil thrower portion 27, and dripped.

Hence, it is possible to reduce a workload of wiping the lubricating oil that flows along the sidewall surface 11*a* of the crankcase 11 and goes around and reaches the lower surface 12*a* of the oil pan 12. Thus, it is possible to provide the easily maintained internal combustion engine 10 including the oil filter 13.

Figure 5:
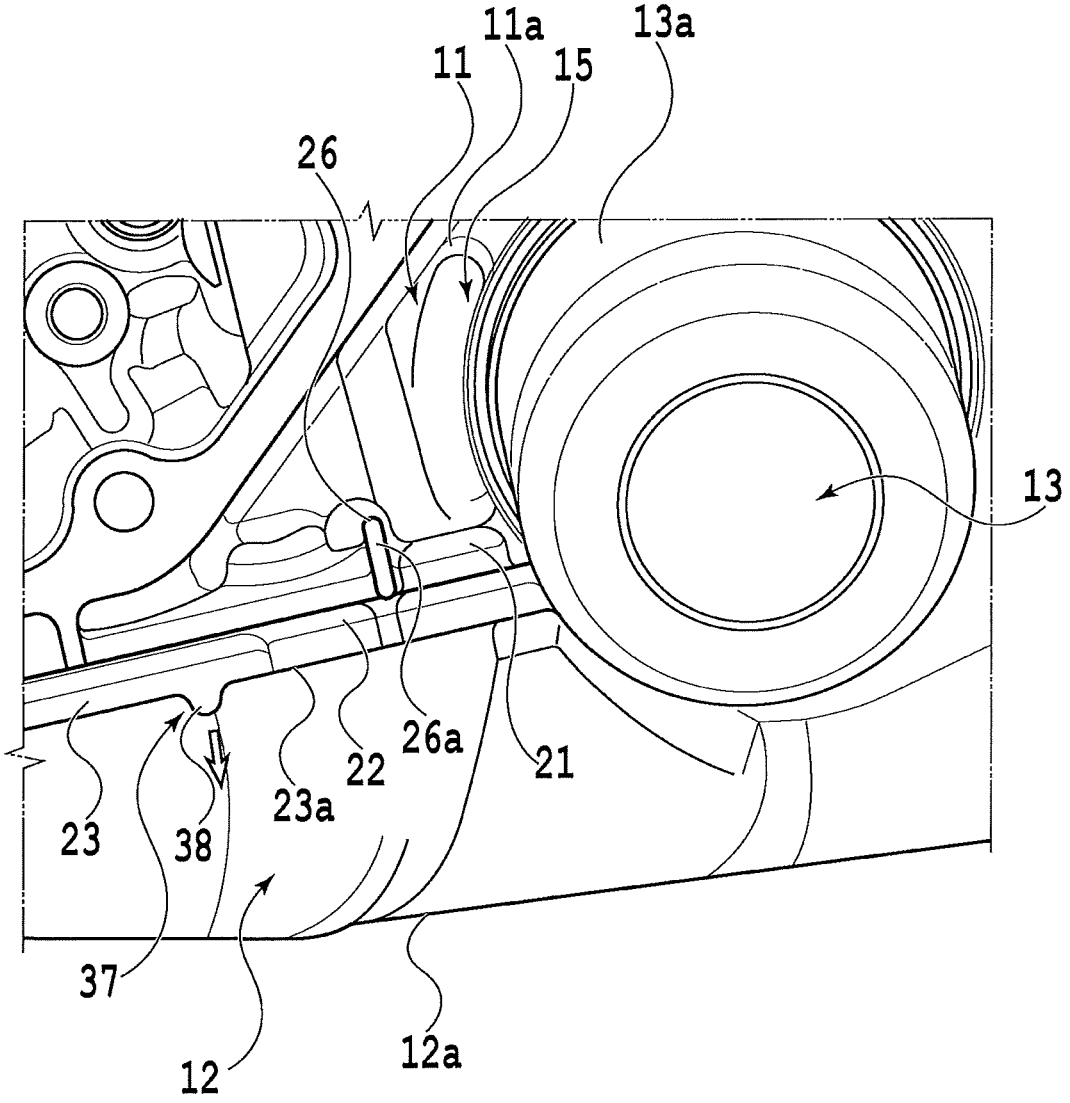
FIG. 5 is an enlarged perspective view of a structure of a main portion of an internal combustion engine according to a first other aspect.
Figure 6:
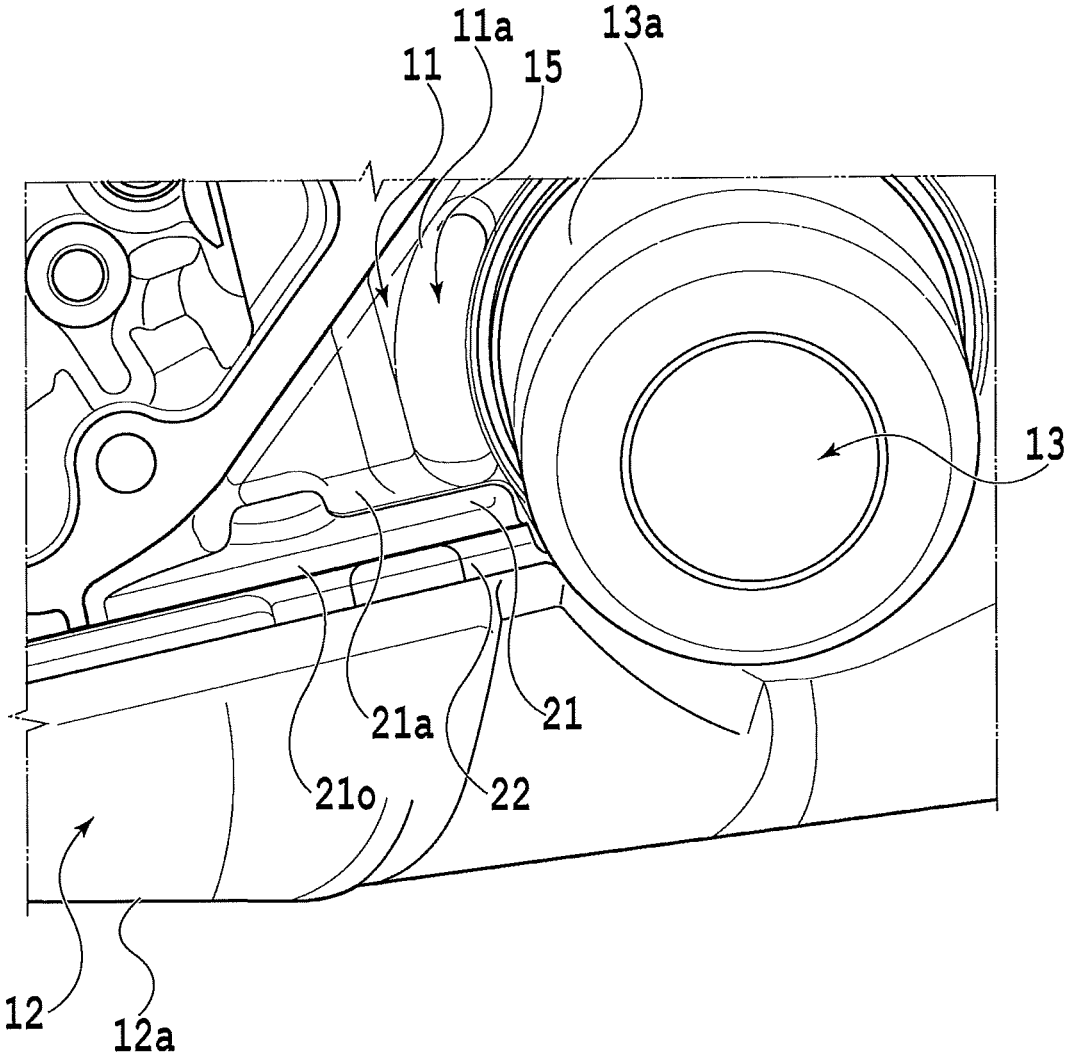
FIG. 6 RELATED ART
FIG. 6 is a bottom view of a structure of a main portion of an internal combustion engine, describing a related art.
Figure 7:
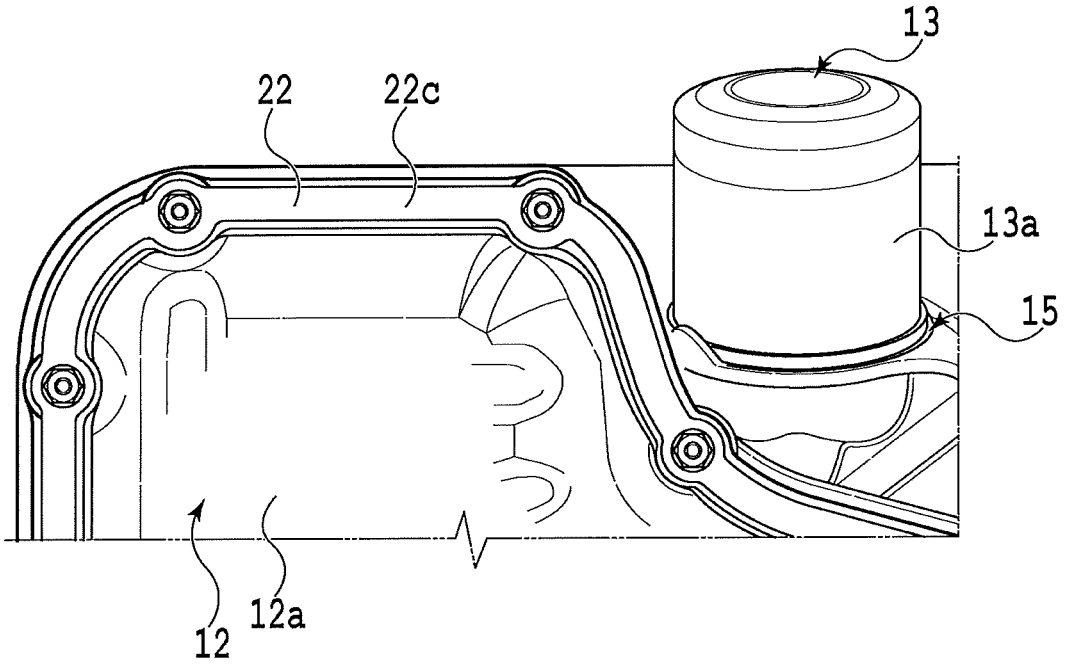
FIG. 7 RELATED ART
FIG. 7 is an enlarged perspective view of the structure of the main portion of the internal combustion engine, describing the related art.

As a first other aspect of the embodiment, as shown in FIG. 5, a third oil thrower portion 37 may be provided instead of the second oil thrower portion 27. The third oil thrower portion 37 is provided in the lower end edge 23*a* of the skirt-shaped portion 23 and is curved so as to have a convex outer edge. In the third oil thrower portion 37, a convex curve edge (a convex edge) 38 having a lowermost apex is formed in the lower end edge 23*a* of the skirt-shaped portion 23. In this case, similarly to the second oil thrower portion 27, even when the lubricating oil leaking out from the filter-attaching portion 15 and flowing along the sidewall surface 11*a* of the crankcase 11 flows along the skirt-shaped portion 23 from the flange-shaped portion 21, the lubricating oil is collected at the apex of the convex curve edge 38 from the lower end edge 23*a* of the skirt-shaped portion 23 and dripped. This means that the convex curve edge 38 of the third oil thrower portion 37 forms the collecting portion that collects the guided lubricating oil to one place, and the lubricating oil is prevented from going around and reaching the lower surface 12*a* of the oil pan 12. Therefore, a workload of wiping and so on is avoided.

As a second other aspect, although not shown, the adjacent lines 23*a*2, 23*a*3 provided on both sides of the concave curve edge 23*a*1, respectively, in the second oil thrower portion 27 may not be inclined, and may be formed into a linear shape in the same level as the base 23*b*. By forming only the concave curve edge 23*a*1 in the lower end edge 23*a* of the skirt-shaped portion 23, only the concave curve edge 23*a*1 on the side of the filter-attaching portion 15 may function as a lowermost apex. In this case, similar action effects are obtained.

Further, as a third other aspect, although not shown, the shape of the first oil thrower portion 26 is not limited to the overhang shape that projects in parallel to the upper surface 21*a* of the flange-shaped portion 21. For example, in the distal end portion 26*a* of the first oil thrower portion 26, a portion may be formed, the portion extending downwardly from the lower surface of the flange-shaped portion 22 of the oil pan 12. Thus, the lubricating oil is guided further down from the distal end portion 26*a* of the first oil thrower portion 26 so that the lubricating oil does not return to the oil pan 12 side.

In the foregoing embodiment, the case is described as an example in which both the first oil thrower portion 26 and the second oil thrower portion 27 are formed. However, the disclosure is not limited to this, and either one of the first oil thrower portion 26 and the second oil thrower portion 27 may be formed in accordance with a leakage amount of the lubricating oil. The case is described as an example in which the second oil thrower portion 27 is installed on the oil pan 12 side. However, the disclosure is not limited to this, and the second oil thrower portion 27 may be formed together with the skirt-shaped portion on the side of the flange-shaped portion 22 of the crankcase 11.

The embodiment of the disclosure has been disclosed. It is obvious to a person skilled in the art that changes can be made without departing from the scope of the disclosure. All of modifications and equivalents are intended to be included in the following claims.

What is claimed is:

1. An internal combustion engine comprising: a case; an oil pan disposed below the case; an oil filter into which oil inside the oil pan flows; a first guide that guides oil flowing out from the oil filter; and a second guide that guides oil flowing out from the oil filter and flowing down along a sidewall surface of the case, the second guide including a projection that is provided continuously in a transverse direction in the sidewall surface of the oil pan and extends so as to project outside the case from the sidewall surface, a descending portion that is extended downward from an outer peripheral edge of the projection, and a collecting portion that is positioned in a lower end edge of the descending portion and collects the oil that flows along the sidewall surface of the case downwardly from the projection through the descending portion, wherein the second guide allows oil to flow down along a lower end edge of the descending portion to allow oil to be collected by a convex-shaped apex of the collecting portion.

2. The internal combustion engine according to claim 1 wherein: the case is a crankcase; and the projection is disposed in a flange that connects the crankcase and the oil pan to each other.

3. The internal combustion engine according to claim 1 wherein the collecting portion is formed into a shape in which the convex-shaped apex of the collecting portion in the lower end edge of the descending portion is at a lowermost position compared to adjacent lines on both sides of the apex.

4. The internal combustion engine according to claim 1 wherein the collecting portion is disposed into the convex-shaped apex in which the apex is at a lowermost position between a concave shape and at least one of adjacent lines of the apex, the concave-shaped apex being made in the lower end edge of the descending portion.

5. The internal combustion engine according to claim 1 further comprising an attaching-detaching portion where the oil filter is attached and detached, the attaching-detaching portion being disposed in the sidewall surface of the case, wherein the first guide is positioned in a fluid passage of oil that flows from the attaching-detaching portion to below the oil pan.

6. The internal combustion engine according to claim 1 wherein: the lower end edge has a convex shape that extends downward, the lower end edge including the convex-shaped apex and adjacent lines positioned on both ends of the apex, respectively; and the apex is the collecting portion and positioned lower than the adjacent lines.

7. The internal combustion engine according to claim 1 wherein: the lower end edge has a concave shape that is depressed upward, the lower end edge including the adjacent lines; the descending portion has a convex portion that is disposed between the concave shape and at least one of the adjacent lines of the concave shape; and the convex portion includes the apex that is positioned lower than the lower end edge, the apex being the collecting portion.

* * * * *